US006734782B2

(12) United States Patent
Kautz et al.

(10) Patent No.: US 6,734,782 B2
(45) Date of Patent: May 11, 2004

(54) SWITCHING DEVICE WITH AN ACTUATOR ELEMENT CONSISTING OF A SHAPE MEMORY ALLOY

(75) Inventors: Stefan Kautz, Rückersdorf (DE); Matthias Marondel, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/089,254

(22) PCT Filed: Jun. 8, 2001

(86) PCT No.: PCT/DE01/02153

§ 371 (c)(1),
(2), (4) Date: Mar. 28, 2002

(87) PCT Pub. No.: WO01/99136

PCT Pub. Date: Dec. 27, 2001

(65) Prior Publication Data

US 2002/0149463 A1 Oct. 17, 2002

(30) Foreign Application Priority Data

Jun. 21, 2000 (DE) ..... 100 30 394

(51) Int. Cl.[7] ..... H01H 37/52

(52) U.S. Cl. ..... 337/333; 337/343; 337/362; 337/365; 337/377; 337/379

(58) Field of Search ..... 337/333, 298, 337/337, 340, 371, 380, 354, 140, 408, 343, 362, 365, 377, 379

(56) References Cited

U.S. PATENT DOCUMENTS 3,846,679 A * 11/1974 Jost et al. ..... 361/165
3,959,691 A 5/1976 Clarke
4,356,478 A * 10/1982 Muggli et al. ..... 340/593
4,510,481 A * 4/1985 Ubukata et al. ..... 337/368
4,517,541 A * 5/1985 Ubukata et al. ..... 337/89
4,551,975 A * 11/1985 Yamamoto et al. ..... 60/528
4,616,206 A 10/1986 Bridges et al.
5,061,914 A * 10/1991 Busch et al. ..... 337/140
5,428,336 A * 6/1995 Smith et al. ..... 337/365
5,659,285 A * 8/1997 Takeda ..... 337/389
5,760,672 A * 6/1998 Wang ..... 337/79
5,825,275 A * 10/1998 Wuttig et al. ..... 337/139
5,844,464 A * 12/1998 Kalapodis et al. ..... 337/140
5,977,858 A * 11/1999 Morgen et al. ..... 337/140
6,005,469 A 12/1999 Kalapodis et al.
6,480,090 B1 * 11/2002 Wang ..... 337/59

FOREIGN PATENT DOCUMENTS

DE 33 38 799 A1 5/1985
DE 298 16 653 1/1999
FR 2 338 565 1/1977
JP 01057546 A * 3/1989 ..... H01H/85/00

OTHER PUBLICATIONS

T. W. Duerig, et al., "Engineering Aspects of Shape Memory Alloys", Butterworth—Heinemann Ltd., pp. 330–337, 1990.
Programmübersicht IEC, Installationsgeräte und systeme.

(List continued on next page.)

*Primary Examiner*—Anatoly Vortman
(74) *Attorney, Agent, or Firm*—Harness, Dickey & Pierce, P.L.C.

(57) ABSTRACT

A switching device includes a strip-shaped actuator element including a shape memory alloy, which is connected to a movable contact part of a switching contact. It is intended that an at least largely extended shape has been impressed into the actuator element at an annealing temperature. It is intended that, in the operating state in which the switching function is not triggered, the element rests on a deflecting element with frictional engagement in such a way that the deflecting element exerts, on the concave inner side of the actuator element, a counterforce partially counteracting the curving of the latter in this state.

36 Claims, 2 Drawing Sheets

OTHER PUBLICATIONS

B. Strnadel, et al., "Cyclic stress–strain characteristics of Ti–Ni–Cu shape memory alloys", Materials Science and Engineering A202, pp. 148–156, 1995.

D. Goldberg et al., "Characteristics of $Ti_{50}Pd_{30}Ni_{20}$high–temperature shape memory alloy", Elsevier Science Limited, pp. 35–46, 1994.

"Compositional Dependence of Martensitic Transformation Sequence in $Ti_{50}Ni_{50-z}Pd_z$ Alloys With X≦15 at %", Pergamon Press Ltd., vol. 27, pp. 1097–1102, 1992.

Marcos Sade et al., "Thermo–Mechanical and Pseudoelastic Fatigue of a Polycrystalline Cu Zn 24 A1 3 Alloy", Eingegangen am 3., Bd. 79, pp. 678–683, May. 1988.

V. Recarte et al., "Precipitation Of The Stable Phases in Cu–A1–Ni Shape Memory Alloys", Elsevier Science Ltd., vol. 34, No. 2, pp. 255–260, 1996.

* cited by examiner

SWITCHING DEVICE WITH AN ACTUATOR ELEMENT CONSISTING OF A SHAPE MEMORY ALLOY

This application is the national phase under 35 U.S.C. § 371 of PCT International Application No. PCT/DE01/02153 which has an International filing date of Jun. 8, 2001, which designated the United States of America, the entire contents of which are hereby incorporated by reference.

FIELD OF THE INVENTION

The invention generally relates to a switching device with an actuator element. Preferably, it includes a shape memory alloy, into which a predetermined shape has been impressed at an annealing temperature and which is connected to a movable contact part of a switching contact. Preferably, a device is included for heating up the actuator element above a temperature level bringing about an opening of the switching contact on the basis of a change in shape of the actuator element.

BACKGROUND OF THE INVENTION

A known switching device is disclosed by the publication "Engineering Aspects of Shape Memory Alloys", published by Butterworth-Heinemann, London (GB) 1990, pages 330 to 337.

Standard circuit-breakers, as are known for example as Siemens circuit-breaker standard range 5SX2/5SX4, have in their current path a magnetically quick-tripping short-circuiting switching contact. This switching contact additionally has a delayed trip for current limitation, in that it can also be thermally opened. For this purpose, a bimetallic strip which is connected to a movable contact part of the switching contact and is indirectly heated up when there is an overload is generally integrated into the current path. This heating-up is accompanied by a curving of the bimetallic strip, which leads to an opening of the switching contact. When the heating ceases, the bimetallic strip returns to its extended shape, closing the switching contact.

It is known from the publication mentioned at the beginning "Engineering Aspects of Shape Memory Alloys" to replace such bimetallic strips by strip-shaped actuator elements consisting of a shape memory alloy. Actuator elements of this type must therefore undergo corresponding curving effects when they are heated up. It is therefore considered necessary to impress a correspondingly curved shape into these elements at relatively high temperatures of, for example, 600 to 850° C. After triggering the shape memory effect at an elevated temperature, for example over 200° C., the transition into the impressed curved shape then takes place. At lower temperatures, in an operating state in which the switching function is not triggered, between approximately room temperature and approximately 200° C., an extended shape of the actuator element is ensured by use of an additional spring element. Thus, a movable contact part of a switching contact mechanically connected indirectly to the actuator element then rests against a fixed contact part.

The production of a corresponding actuator element is relatively cost-intensive, however, because of the annealing at high temperature for the impressing of the curved shape.

SUMMARY OF THE INVENTION

It is therefore an object of an embodiment of the present invention to design the switching device in such a way that lower-cost actuator elements including a shape memory alloy can be used.

An object can be achieved according to an embodiment of the invention by providing an actuator element into which an at least largely extended shape has been impressed. This can be done at the annealing temperature. Further, it can include a curved shape in the operating state in which the switching function is not triggered, and which rests between its one end, which is held fixed; and at its other end, which is facing the movable contact part, on a deflecting element with frictional engagement in such a way that the deflecting element exerts on the concave inner side of the actuator element a counterforce partially counteracting the curving of the latter.

Advantages associated with this configuration of the switching device can be seen on the one hand in that a low-cost annealing of the actuator element in an at least largely extended, i.e. straight, shape (with the inclusion of slight deviations from this) is made possible, in particular in the rolled state of a corresponding metal sheet. The consequence of this is that the actuator element can assume a curved shape in the operating state at low temperature.

The curving of the actuator element can in this case be achieved in various ways, including but not limited to: the actuator element having what is known as a 2-way effect on account of corresponding preparational conditions, i.e. two different shapes (curved and extended) have been impressed into it in a way known per se for the two different temperature ranges (of the operating state and triggering state), so that the element curves of its own accord at the lower temperature; and in the case of actuator elements with what is known as a 1-way effect, the curved starting position can be ensured by a special (external) restoring spring. The force to be expended for this purpose is relatively low on account of the material.

In the case of these types, however, without the use of a deflecting element according to an embodiment of the invention, the electrical and mechanical connection of the actuator element at its fixed end to a part of the switching device can be subjected to loading on account of a relatively high lever effect during its thermally induced change in shape. This can occur since the customary alloys of actuator elements with shape memory properties tend on account of their general intermetallic crystalline structure toward brittle mechanical behavior, which specifically in the connecting technique required at the end mentioned, for example by welding or clamping, can have potentially disadvantageous effects on the quality of the corresponding contact point.

However, corresponding potential disadvantages can at least largely be eliminated by the use, according to an embodiment of the invention, of the deflecting element. This can occur since this deflecting element is arranged such that it is fixed in such a way that a force which attempts to bend the actuator element back in the direction of its extended shape is exerted on the actuator element that is in fact curving at the operating temperature. This counterforce is then discontinued when the actuator element is heated, in that the actuator element goes over at least largely into its extended shape. This produces a major advantage of a mechanical relief of the actuator element in a mechanical connecting region (clamping D point) of its fixed end during frequent movements for opening and closing the switching contact.

Since shape memory materials are generally not as low in cost as bimetal, it is generally attempted to reduce the use of material for corresponding circuit-breaker device with overcurrent trip by actuator elements including shape memory material. Problems can be encountered here when using corresponding actuator elements such as those in the prior art according to the cited publication "Engineering Aspects of Shape Memory Alloys" with regard to the mechanical stability at the clamping point if the strip-shaped actuator elements are designed to be too narrow and too thin. This can occur since lever effects can cause undesired deformations to occur at these elements, which can result in the failure of the switching contact. The partial bending-straight, according to an embodiment of the invention, of the actuator element by use of the deflecting element significantly counteracts this problem. This is so since the resting effect brings about the mentioned significant relief of the mechanical connection at the fixed end.

A further advantage of the use of a corresponding deflecting element is the way in which it governs the bending-straight of the actuator element. Since the connecting point at the fixed end of the actuator element represents a mechanical weakpoint on account of the lever arm and, although the strip-shaped actuator element would bend straight, the torsional moment at the contact point induces a curving effect, the use of a deflecting element of this type is indeed particularly important.

In addition, the actuator elements which can be used for the switching device are relatively low in cost. This is so because the desired switching behavior can also be achieved with a significant reduction in the volume of the shape memory material, compared with the customary actuator elements, for example according to the publication cited at the beginning.

Other advantageous configurations of the switching device can also emerge according to other embodiments of the invention.

For instance, a restoring spring keeping its actuator element in its curved shape in the operating state may be provided, in particular for the switching device. In this way, relatively low-cost actuator elements including shape memory alloys with what is known as a 1-way effect can be used.

Furthermore, it is advantageous if the actuator element is connected to the movable contact part electrically by using a stranded wire and mechanically by use of a switching linkage. Use of the stranded wire indicates that the mobility of the movable end of the actuator element is virtually unrestricted. The actuator element can consequently be integrated into a current path.

BRIEF DESCRIPTION OF THE DRAWINGS

For further explanation of embodiments of the invention, reference is made below to the drawings, in which.

In the figures, corresponding parts are respectively provided with the same reference numerals.

DETAILED DESCRIPTION OF THE PREFERRED EMBODIMENTS

Figure 1:
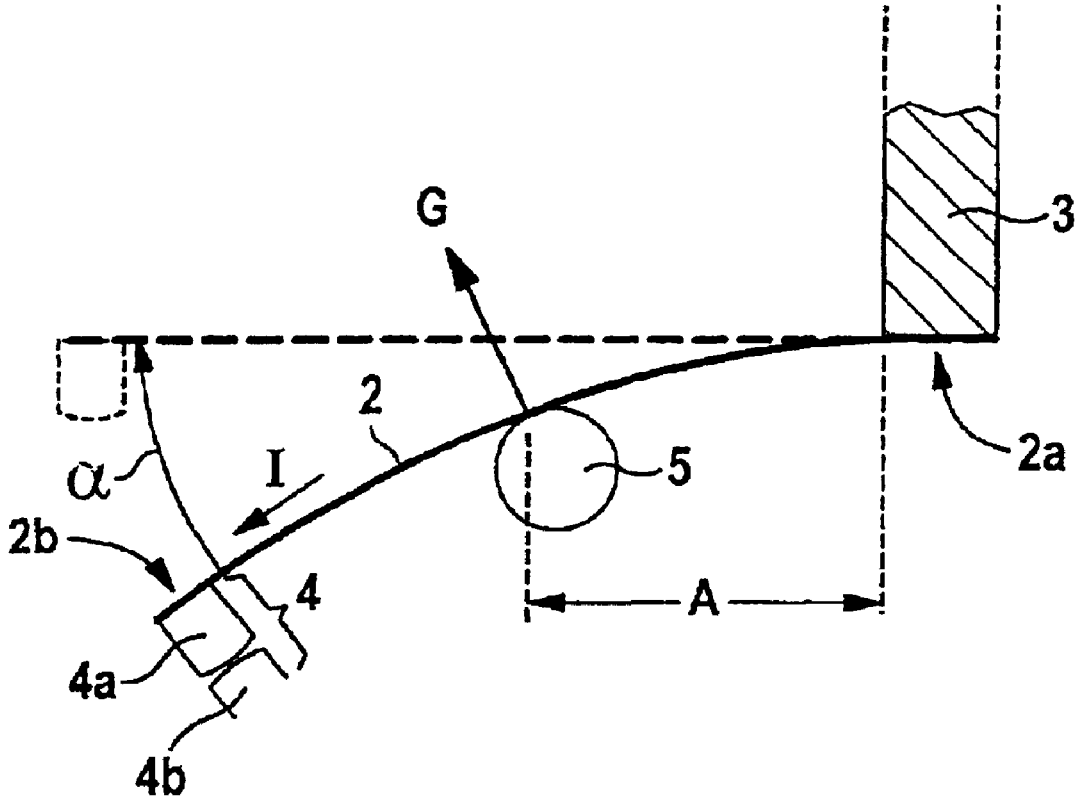
FIG. 1 schematically shows the basic functional mode of an actuator element for use in a circuit-breaker and FIG. 2 shows detail of an actual exemplary embodiment of a corresponding circuit-breaker.

The actuator element 2 shown in FIG. 1, including known shape memory alloys, expediently has a strip or band shape. It includes at least partially one of the known shape memory alloys. Ti—Ni alloys are to be regarded as particularly suitable. For example, variously composed Ti—Ni and Ti—Ni—Cu alloys are disclosed by "Materials Science and Engineering", Vol. A 202, 1995, pages 148 to 156. Various $Ti_{50}Ni_{50-x}Pd_x$ shape memory alloys are described in "Intermetallics", Vol. 3, 1995, pages 35 to 46 and "Scripta METALLURGICA et MATERIALIA", Vol. 27, 1992, pages 1097 to 1102. It goes without saying that, instead of the Ti—Ni alloys, other shape memory alloys are also suitable. For example, Cu—Al shape memory alloys come into consideration. The corresponding CuZn24A13 alloy is disclosed by "Z. Metallkde.", Volume 79, issue 10, 1988, pages 678 to 683. A further Cu—Al—Ni shape memory alloy is described in "Scripta Materialia", Vol. 34, No. 2, 1996, pages 255 to 260. It goes without saying that further alloying constituents, such as Hf for example, can be alloyed in a way known per se in addition to the aforementioned binary or ternary alloys. For the sake of the exemplary embodiments explained below, it can be assumed that a Ti—Ni shape memory alloy, for example, is selected.

In a way known per se, a predetermined shape has been impressed into the actuator element by annealing above 350° C., for example at a temperature between 400 and 850° C. According to an embodiment of the invention, an at least largely extended shape is to be produced at this temperature. This then leads to the actuator element at lower temperatures either attempting to assume a curved shape (in the case of the 2-way effect type), without any external force acting, or being made to curve by use of a very small external force (in the case of the 1-way effect type). These lower temperatures generally lie in a temperature range below 200° C., which can be regarded as the operating state in which a switching state is not yet triggered.

According to FIG. 1, a correspondingly curved, strip-shaped actuator element 2 is to be rigidly connected at an axial end 2*a* to a fixed part 3, for example a housing part, of a switching device according to an embodiment of the invention, in such a way that a good mechanical and electrical contact with respect to the part 3 is ensured. At the opposite other end 2*b* of the actuator element 2 there is a movable contact part 4*a* of a switching contact 4. As assumed in the case of the exemplary embodiment represented, this contact part is either attached directly to the actuator element 2 or can be moved by the latter indirectly by using a mechanism. An assigned fixed contact part of the switching contact is not shown in any more detail in the figure and is denoted by 4*b*.

According to an embodiment of the invention, the curving of the actuator element 2 is counteracted in the operating state, in that a counterforce G acts on its concave (curving) inner side between its two ends 2*a* and 2*b*. For this purpose, a fixed cylindrical deflecting element 5, known as a "deflecting pin", is provided. The arrangement of this "pin" is chosen in this case in such a way that the counterforce G partially counteracts the curving tendency of the actuator element 2. The deflecting element 5 thereby presses on the actuator element 2, for example approximately in its center between the two ends 2*a* and 2*b*. It is generally arranged at a distance A of a few centimeters, for example approximately 1 cm, away from the fixed end 2*a*. In this case it is intended by appropriate arrangement of the deflecting element 5 to exert a counterforce G of such a magnitude that a curving of the actuator element 2 still occurs at low temperatures. If the actuator element is then heated up beyond a temperature high enough for a switching function (by opening of the switching contact), in particular over 200° C., it assumes at least largely its impressed extended shape, indicated in the figure by a dashed line, passing over an angle of curvature or arc $\alpha$. The frictional engagement with respect to the deflecting element 5 is in this case at least largely overcome.

As can be seen from the figure, the position of the deflecting element 5 must consequently be chosen from the aspect of a displacement of the movable contact part 4*a* that is sufficiently large for contact opening. Choice of the position is governed here not only by the distance A from the fixed end 2*a* but also by the temperature of the heating or heating-up in the case of an overcurrent.

The heating may in this case take place in a direct way, in that a current I passed via the actuator element 2 leads to the heating-up of the latter on account of the ohmic resistance of this element. In addition, however, indirect heating-up is also possible, in that a current-dependent heating effect of a heating element which has a thermal effect on the actuator element 2 is brought about.

Figure 2:
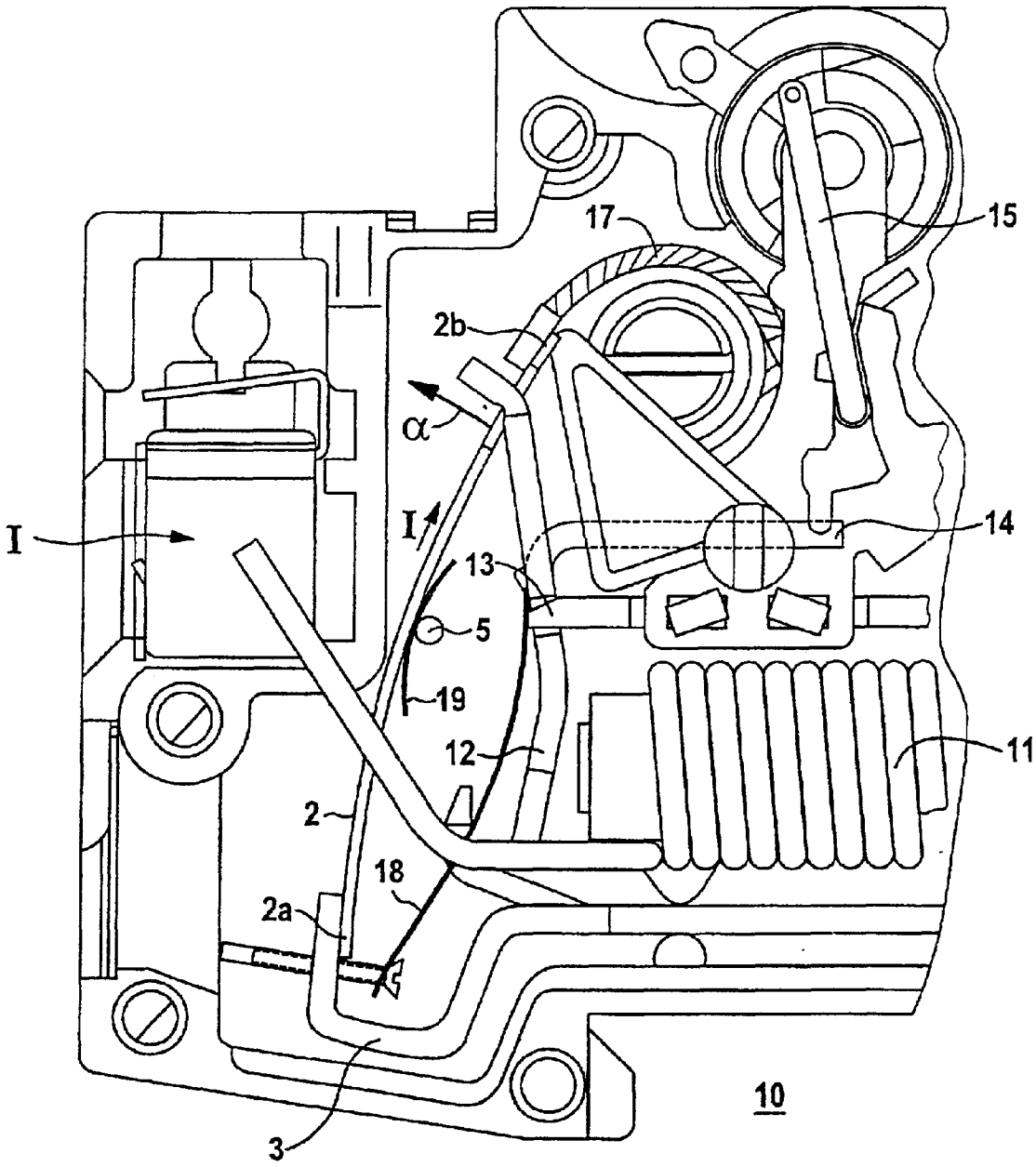

FIG. 2 shows the parts of a switching device 10 for an embodiment of the invention. Where the parts are not shown in any more detail here, a construction of a known circuit-breaker can be assumed (cf. the mentioned Siemens standard range of circuit-breakers 5SX/5SX4). The switching device has, inter alia, the following parts, that is a short-circuiting trip with an electromagnet 11, a tripping rocker 12 of ferromagnetic material, which is mounted about a pivot point 13 and, in the case of short-circuiting, is attracted at one end by the magnet 11, a switching linkage 14, which is connected to the rocker 12 and to a movable contact part of a switching contact, which cannot be seen in the figure, and opens the switching contact or keeps it closed, depending on the pivoting position of the rocker, a mechanism 15 supporting the switching function of the switching contact, with various parts not shown in any more detail in the figure, a (copper) stranded wire 17 of a current path leading to the movable contact part of the switching contact, a fixed housing part 3 as part of the current path in the form of a steel frame and a strip-shaped actuator element 2 including a shape memory alloy, the fixedly-held end 2*a* of which is connected in an electrically conducting and mechanically secure manner to the housing part 2 and to the movable end 2*b* of which the stranded wire 17 is correspondingly securely attached. The tripping rocker 12 also acts on this end.

Since the actuator element 2 according to the chosen exemplary embodiment is intended to be of the 1-way effect type, as it is known, it can also include a special restoring spring 18, with the aid of which the tripping rocker 12, and consequently also the actuator element 2, are restored to the starting position of the operating state (at the lower operating temperature) or are kept in this position. The restoring force to be applied for this purpose by the spring 18 is relatively small.

The actuator element 2 is shown in FIG. 2 in its corresponding, closed position, in which the movable contact part, connected with its movable end 2*b* by means of the stranded wire 17, rests against the fixed contact part of the switching contact. The actuator element has in this case a relatively small curvature, since a counterforce G is exerted on its concave inner side by the deflecting element 5 located approximately in the center between the two ends of the actuator element, the counterforce being exerted for example via a film-like intermediate element 19, for example made of Kapton. By indirect heating of the actuator element, in particular in that a current passing via it goes into an overcurrent range and induces sufficient warming of the element on account of Joulean losses, the actuator element goes over into its at least approximately extended shape, passing through an angle of curvature $\alpha$. As it does so, it takes with it the tripping rocker 12 acting on its end 2*b*, so that the opening of the switching contact is brought about by means of the switching linkage 14 mechanically connected to the rocker, by the movable contact part being lifted off the fixed contact part. An overcurrent trip of the circuit-breaker is performed in this way.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switching device, comprising:

an actuator element including a shape memory alloy, into which an extended shape is impressed at an annealing temperature, the actuator element being fixed at one end and being connected to a movable contact part of a switching contact of the switching device at another end; and means for heating up the actuator element above a temperature level bringing about an opening of the switching contact on the basis of a change in shape of the actuator element, wherein the actuator element is curved in shape in an operating state in which a switching function of the switching device is not triggered, and wherein a deflecting element exerts, on a concave inner side of the actuator element, a counterforce partially counteracting the curve of the actuator element only in the operating state in which the switching function of the switching device is not triggered.

2. The device as claimed in claim 1, wherein the actuator element rests against the deflecting element approximately in a center of the deflecting element, between its two ends.

3. The device as claimed in claim 1, wherein the actuator element is part of a current path and is heatable by an overcurrent above the temperature level bringing about the opening of the switching contact.

4. The device as claimed in claim 1, wherein the actuator element is indirectly heatable.

5. The device as claimed in claim 1, further comprising:

a restoring spring, adapted to keep the actuator element in its curved shape in the operating state.

6. The device as claimed in claim 1, wherein the actuator element is connected to the movable contact part electrically via a stranded wire and mechanically via a switching linkage.

7. The device as claimed in claim 1, wherein the actuator element includes a shape memory alloy based on at least one of a NiTi and CuAl alloy.

8. The device as claimed in claim 1, wherein the actuator element is strip shaped.

9. The device as claimed in claim 2, wherein the actuator element is part of a current path and is heatable by an overcurrent above the temperature level bringing about the opening of the switching contact.

10. The device as claimed in claim 2, wherein the actuator element is indirectly heatable.

11. The device as claimed in claim 2, further comprising:

a restoring spring, adapted to keep the actuator element in its curved shape in the operating state.

12. The device as claimed in claim 2, wherein the actuator element is connected to the movable contact part electrically via a stranded wire and mechanically via a switching linkage.

13. The device as claimed in claim 2, wherein the actuator element includes a shape memory alloy based on at least one of a NiTi and CuAl alloy.

14. The device as claimed in claim 6, wherein the actuator element includes a shape memory alloy based on at least one of a NiTi and CuAl alloy.

15. The device as claimed in claim 1, wherein the switching device is a circuit breaker.

16. An actuator element for a switching device, comprising:

a shape memory alloy, into which an extended shape is impressed at an annealing temperature, the shape memory alloy being fixed at one end, being connected to a movable contact part of a switching contact of the switching device at another end and being curved in shape in an operating state in which a switching function of the switching device is not triggered, wherein the shape memory alloy is heatable above a temperature level to bring about an opening of the switching contact on the basis of a change in shape of the shape memory alloy and wherein a deflecting element exerts, on a concave inner side of the shape memory alloy, a counterforce partially counteracting the curve of the actuator element only in the operating state in which the switching function of the switching device is not triggered.

17. The actuator element as claimed in claim 16, wherein the actuator element rests against the deflecting element approximately in a center of the deflecting element, between its two ends.

18. The actuator element as claimed in claim 16, wherein the actuator element is part of a current path and is heatable by an overcurrent above the temperature level bringing about the opening of the switching contact.

19. The actuator element as claimed in claim 16, wherein the actuator element is indirectly heatable.

20. The actuator element as claimed in claim 16, wherein the actuator element is connected to the movable contact part electrically via a stranded wire and mechanically via a switching linkage.

21. The actuator element as claimed in claim 16, wherein the actuator element includes a shape memory alloy based on at least one of a NiTi and CuAl alloy.

22. The actuator element as claimed in claim 16, wherein the actuator element is strip shaped.

23. A switching device, comprising:

a switching contact;

an actuator element, fixed at one end, connected to a movable contact part of the switching contact at another end and heatable above a temperature level to bring about an opening of the switching contact based upon a change in shape of the actuator element; and a deflecting element, wherein the actuator element is curved in shape in an operating state in which a switching function of the switching device is not triggered, and wherein the deflecting element exerts, on a concave inner side of the actuator element, a counterforce partially counteracting the curve of the actuator element only in the operating state in which the switching function of the switching device is not triggered.

24. The device as claimed in claim 23, wherein the actuator element rests against the deflecting element approximately in a center of the deflecting element, between its two ends.

25. The device as claimed in claim 23, wherein the actuator element is part of a current path and is heatable by an overcurrent above the temperature level bringing about the opening of the switching contact.

26. The device as claimed in claim 23, wherein the actuator element is indirectly heatable.

27. The device as claimed in claim 23, further comprising:

a restoring spring, adapted to keep the actuator element in its curved shape in the operating state.

28. The device as claimed in claim 23, wherein the actuator element is connected to the movable contact part electrically via a stranded wire and mechanically via a switching linkage.

29. The device as claimed in claim 23, wherein the actuator element includes a shape memory alloy based on at least one of a NiTi and CuAl alloy.

30. The device as claimed in claim 23, wherein the actuator element is strip shaped.

31. The device as claimed in claim 1, wherein the deflecting element is in frictional engagement with the actuator element.

32. The device as claimed in claim 16, wherein the deflecting element is in frictional engagement with the shape memory alloy.

33. The device as claimed in claim 23, wherein the deflecting element is in frictional engagement with the actuator element.

34. The device as claimed in claim 1, wherein an intermediate element is included between the actuator element and the deflecting element.

35. The device as claimed in claim 16, wherein an intermediate element is included between the deflecting element and the shape memory alloy.

36. The device as claimed in claim 23, wherein an intermediate element is included between the actuator element and the deflecting element.

* * * * *